US007349659B2

(12) United States Patent
Kakishima et al.

(10) Patent No.: US 7,349,659 B2
(45) Date of Patent: Mar. 25, 2008

(54) IMAGE FORMING APPARATUS FOR FIXING A TONER IMAGE

(75) Inventors: Aya Kakishima, Kanagawa (JP); Yasushi Nagata, Kanagawa (JP); Yasuyuki Kobayashi, Kanagawa (JP); Tatsunori Izawa, Kanagawa (JP); Junpei Amano, Kanagawa (JP); Toru Inoue, Kanagawa (JP); Tetsuo Yamada, Kanagawa (JP); Atsumi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 81 days.

(21) Appl. No.: 11/350,036

(22) Filed: Feb. 9, 2006

(65) Prior Publication Data

US 2007/0048039 A1 Mar. 1, 2007

(30) Foreign Application Priority Data

Aug. 23, 2005 (JP) ..... P2005-241466

(51) Int. Cl.
*G03G 15/20* (2006.01)

(52) U.S. Cl. ..... 399/327

(58) Field of Classification Search ..... 399/98, 399/99, 326, 327

See application file for complete search history.

(56) References Cited

U.S. PATENT DOCUMENTS 5,625,442 A * 4/1997 Seki ..... 399/327
6,665,514 B1 * 12/2003 Miyazaki ..... 399/327
6,771,925 B2 * 8/2004 Satoh ..... 399/327
6,778,803 B2 * 8/2004 Matsumoto ..... 399/327 X

FOREIGN PATENT DOCUMENTS

| | | |
|---|---|---|
| JP | 07-281547 | * 10/1995 |
| JP | 08-069200 | * 3/1996 |
| JP | 2001-013812 | * 1/2001 |
| JP | 2003-076200 | 3/2003 |

* cited by examiner

*Primary Examiner*—Sandra L. Brase
(74) *Attorney, Agent, or Firm*—Morgan, Lewis & Bockius LLP

(57) ABSTRACT

An image forming apparatus includes an image forming section which transfers toner onto a latent image to form a toner image, a transfer section which transfers the toner image onto a recording material directly or via an intermediate transfer body, a fixing section which has a pair of rotatable members contacted and pressed each other, in which the recording material carrying the toner image is passed through the pair of rotatable members, and heats and presses the toner image to fix the toner image on the recording material, a cleaning section which cleans a peripheral surface of one of the pair of rotatable members, a paper dust amount measuring section which measures an amount of paper dust separably adhering to the recording material, before the toner image is transferred, and a control section which controls a cleaning operation rate of the cleaning section based on the measured amount of paper dust.

9 Claims, 3 Drawing Sheets

IMAGE FORMING APPARATUS FOR FIXING A TONER IMAGE

CROSS-REFERENCE TO RELATED APPLICATIONS

This application is based upon and claims the benefit of priority from the prior Japanese Patent Applications No. 2005-241466, filed on Aug. 23, 2005, the entire contents of which are incorporated herein by reference.

BACKGROUND OF THE INVENTION

1. Field of the Invention

The present invention relates to an image forming apparatus that forms a toner image by selectively transferring the toner onto a latent image due to differences of electrostatic potential, transfers the toner image onto the recording material, and then forms a fixed image by heating and pressing the toner image.

2. Description of the Related Art

In an image forming apparatus using a powdered toner, a process of fixing a toner image generally includes electrostatically transferring the toner image directly onto a recording material, or primarily transferring the toner image onto an intermediate transfer body and secondarily transferring it onto the recording material, then heating and melting the toner containing a thermoplastic resin binder and transferring it onto the recording material. This thermal fixing method includes passing the recording material carrying an unfixed toner image a nip part between a heating rotatable member and a pressing rotatable member contacted and pressed to fix the toner image, and is most widely employed because of its advantages that the toner image can be fixed at low electric power, and there is less danger of burning due to paper jam in a fixing part.

The heating rotatable member has a hollow core bar of aluminum or the like, and a heater provided inside it, and is covered with fluororesin on the surface to improve the release characteristics. Also, the pressing rotatable member is provided with an elastic layer on a metallic core bar, and covered with a fluororesin tube having good release characteristics on the surface layer.

Since the fluororesin based material has high electrical insulating property and is easily charged, when the recording material with unfixed toner is passed through the nip part, there occurs a phenomenon that a part of the unfixed toner on the recording sheet adheres to the surface of the heating rotatable member, causing an offset. The offset toner adheres to the recording material to be conveyed next, contaminating the recording material, or causing an image defect.

Besides, it has been newly found that one of the causes that the toner is offset to the heating rotatable member is that the paper dust adhering to the heating rotatable member induces the offset. Accordingly, there is a demand for means for preventing the offset caused by the paper dust effectively.

Recently, the recycled paper is often used from the viewpoint of the forest resource maintenance or the global environment maintenance. Also, the inferior paper (called "low cost paper") have been often used to reduce the cost of the recording material. Since more paper dust may separably adhere to the recycled paper or the low cost paper, a part of paper dust may often adhere to the heating rotatable member, when employed in the image forming apparatus. And when the recording material carrying the unfixed toner is passed through a nip part between the heating rotatable member and the pressing rotatable member, the unfixed toner is transferred to the paper dust adhering to the heating rotatable member, causing the offset of the toner around the peripheral surface of the heating rotatable member. Especially when fixing the image having low image density and a large white portion to which no toner is transferred, the paper dust existing in the white portion is likely to adhere to the heating rotatable member. The adhering paper dust induces the offset of the toner, often leading to an image contamination.

SUMMARY OF THE INVENTION

The invention is achieved based on a causal relationship between the adhesion of paper dust to the heating rotatable member and the offset of toner. The present invention provides an image forming apparatus in which an offset phenomenon is prevented and there occurs no image defect over the long time, even when the recycled paper or low cost paper is employed as the recording material.

According to an aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which has a pair of rotatable members contacted and pressed each other, in which the recording material on which the toner image is transferred is passed through the pair of rotatable members, and heats and presses the toner image to fix the toner image on the recording material, a cleaning section which cleans a peripheral surface of one of the pair of rotatable members of the fixing section, a paper dust amount measuring section which measures an amount of paper dust separably adhering to the recording material, before the toner image is transferred, and a control section which controls a cleaning operation rate of the cleaning section based on the amount of paper dust measured by the paper dust amount measuring section.

According to another aspect of the present invention, an image forming apparatus includes an image forming section which transfers toner onto a latent image due to a difference of electrostatic potential to form an image including a toner image, a transfer section which transfers the toner image onto a recording material directly or via an intermediate transfer body, a fixing section which has a pair of rotatable members contacted and pressed each other, in which the recording material on which the toner image is transferred is passed through the pair of rotatable members, and heats and presses the toner image to fix the toner image on the recording material, a cleaning section which cleans a peripheral surface of one of the pair of rotatable members of the fixing section, and a control section which controls a cleaning operation rate of the cleaning section based on a density of a portion where the toner is transferred in the image formed by the image forming section.

According to still another aspect of the present invention, an image forming apparatus includes an image forming section which transfers toner onto a latent image due to a difference of electrostatic potential to form an image including a toner imaged, a transfer section which transfers the toner image onto a recording material directly or via an intermediate transfer body, a fixing section which has a pair of rotatable members contacted and pressed each other, in which the recording material on which the toner image is transferred is passed through the pair of rotatable members, and heats and presses the toner image to fix the toner image on the recording material, a cleaning section which cleans a peripheral surface of one of the pair of rotatable members of the fixing section, a paper dust amount measuring section which measures an amount of paper dust separably adhering to the recording material, before the toner image is transferred, and a control section which controls a cleaning operation rate of the cleaning section based on at least one of the amount of paper dust measured by the paper dust amount measuring section and a density of portion where the toner is transferred in the image formed by the image forming section.

DETAILED DESCRIPTION OF THE EMBODIMENTS

The exemplary embodiment of the present invention will be described below with reference to the drawings.

Figure 1:
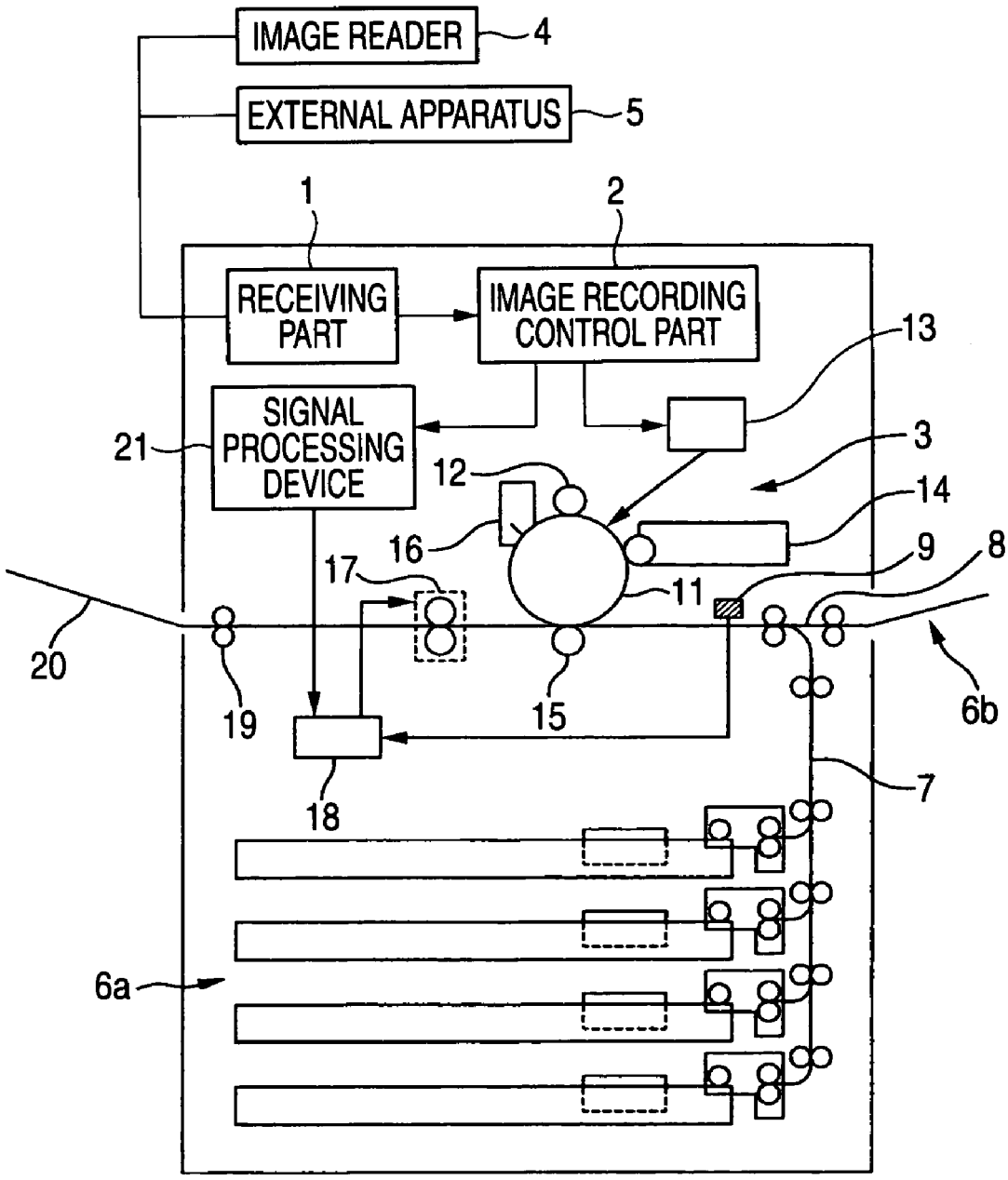
FIG. 1 is a schematic block diagram showing the configuration of an image forming apparatus according to an exemplary embodiment of the present invention.

FIG. 1 is a schematic block diagram showing the configuration of an image forming apparatus according to an exemplary embodiment of the invention.

This image forming apparatus includes a receiving part 1 connected via the communication line to an image reader 4 and an external apparatus 5 of personal computer or the like, an image recording control part 2 for performing the image processing based on image information inputted into the receiving part 1, and an image forming part 3 for forming an image based on a digital image signal outputted from the image recording control part 2. Also, the image density for this digital image signal is counted by a signal processing device 21 (e.g., video counter), and its information is inputted into a fixing control part 18 for controlling a fixing unit 17.

A sheet supply portion 6*a* for supplying the recording sheets one by one to the image forming part 3 is disposed under the image forming part 3. Also, a manual sheet supply portion 6*b* for replenishing the recording sheet directly from the outside is provided on the side. And a first sheet conveying path 7 for delivering the recording sheet from the sheet supply portion 6*a* to the image forming part 3 and a second sheet conveying path 8 for delivering the recording sheet from the manual sheet supply portion 6*b* to the image forming part 3 are provided and joined on the upstream side of a position where the toner image is transferred from the image forming part.

On the downstream side of the position where the sheet conveying paths 7 and 8 are joined, a paper dust amount measuring device 9 is disposed to face the sheet conveying paths to measure the amount of paper dust separably adhering to the recording sheet to send the information to the fixing control part 18. And the recording sheet passing through a position facing the paper dust amount measuring device 9 is forwarded to the image forming part 3.

Also, the fixing unit 17 for fixing the toner image on the recording sheet by heating and pressing it thereon is provided on the downstream side of the image forming part 3. And a paper exit roller 19 for outputting the recording sheet out of the device is provided downstream of the fixing unit 17 to convey the recording sheet onto a paper exit tray 20.

The image forming part 3 includes a cylindrical photosensitive drum 11 for forming a latent image due to differences of electrostatic potential on the surface, when imaging light is applied after it is uniformly charged. Also, around a peripheral surface of the photosensitive drum 11, the image forming part 3 includes a charging unit 12 for uniformly charging the surface of the photosensitive drum 11, an exposing unit 13 for forming the latent image on the surface of the photosensitive drum 11 by applying an imaging light to the photosensitive drum 11, a developing unit 14 for forming the toner image by selectively transferring the toner to the latent image on the photosensitive drum, a transferring unit 15 for transferring the toner image formed on the photosensitive drum 11 to the recording sheet, and a cleaning unit 16 for photosensitive drum to remove the toner remaining on the photosensitive drum 11 after transferring the toner image.

The photosensitive drum 11 is formed with a photosensitive layer, which is made of an inorganic photosensitive material, an organic photosensitive material, an amorphous selenium photosensitive material or an amorphous silicon photosensitive material, such as Se, a-Si, a-SiC or Cds, on the metallic drum surface.

The charging unit 12, which is coated with a highly resistive material around a metallic roll having electrical conductivity made of stainless steel or aluminum, is brought into contact with the photosensitive drum 11 and rotated. And when a predetermined voltage is applied, a continuous discharge is caused within a minute gap near a contact part between the roll and the photosensitive drum 11 to charge almost uniformly the surface of the photosensitive drum 11.

The exposing unit 13 includes a laser generator that flashes on or off for every pixel based on an image signal and exposes the peripheral surface of the photosensitive drum 11 to light using a polygon mirror. Thereby, a potential of the exposing part is attenuated on the peripheral surface of the photosensitive drum 11, so that a latent image is formed due to differences of electrostatic potential.

The developing unit 14 forms a visible image by transferring the toner to the latent image in an electric field occurring around the opposite position of the photosensitive drum 11.

Figure 2:
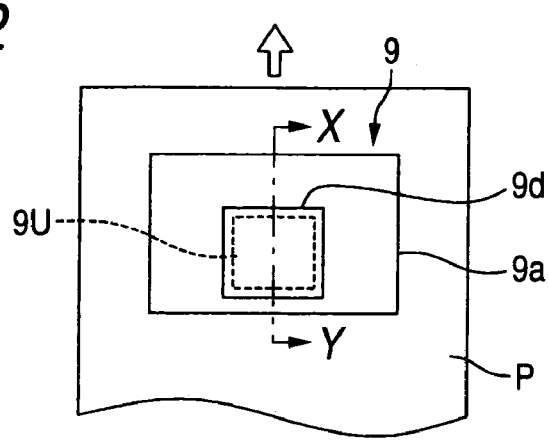
FIG. 2 is a schematic plan view of a paper dust amount measuring device for use in the image forming apparatus as shown in FIG. 1.
Figure 3:
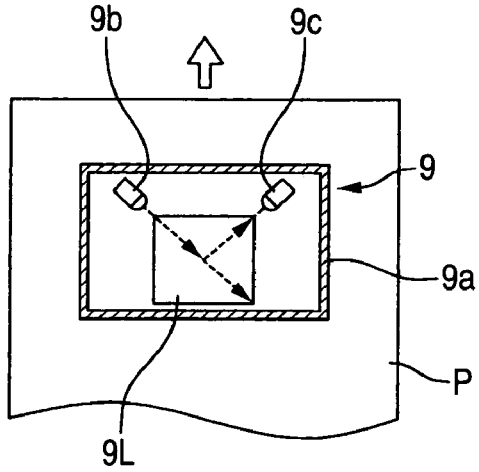
FIG. 3 is a cross-sectional plan view of the paper dust amount measuring device for use in the image forming apparatus as shown in FIG. 1.
Figure 4:
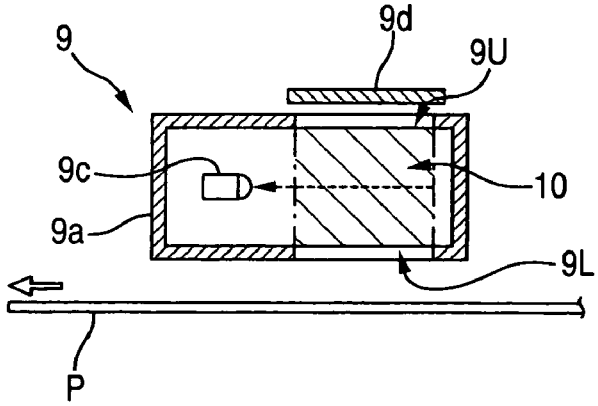
FIG. 4 is a cross-sectional view of the paper dust amount measuring device as shown in FIG. 2, taken along the line X-Y.

Referring to FIGS. 2 to 4, the paper dust amount measuring device 9 will be described below. FIG. 2 is a plan view of the paper dust amount measuring device 9, FIG. 3 is a cross-sectional plan view of the paper dust amount measuring device 9, and FIG. 4 is a cross-sectional elevation view of the paper dust amount measuring device as shown in FIG. 2, taken along the line X-Y.

The paper dust amount measuring device 9 has an LED (Light Emitting Diode) 9*b* and a phototransistor (light receiving element) 9*c* inside a housing 9*a*, and is provided with the measuring openings 9U and 9L on the upper and lower surfaces of the housing 9*a*, respectively. And an electrode 9*d* is placed above the measuring opening 9U on the upper surface, and sucks up the paper dust on the recording sheet passing under the paper dust amount measuring device 9. Light emitted by the LED 9*b* is applied to a measurement space 10 between the measuring openings 9U and 9L to irradiate the paper dust within the measurement space 10, and become a scattered light. The phototransistor 9*c* is placed at a position capable of sensing this scattered light and receives the scattered light. The amount of received light by the phototransistor 9*c* is proportional to the amount of paper dust existing within the measurement space 10, namely, the amount of paper dust sucked from the recording sheet. The amount of received light by the phototransistor 9*c* is read as a voltage signal into the fixing control part 18.

Figure 5:
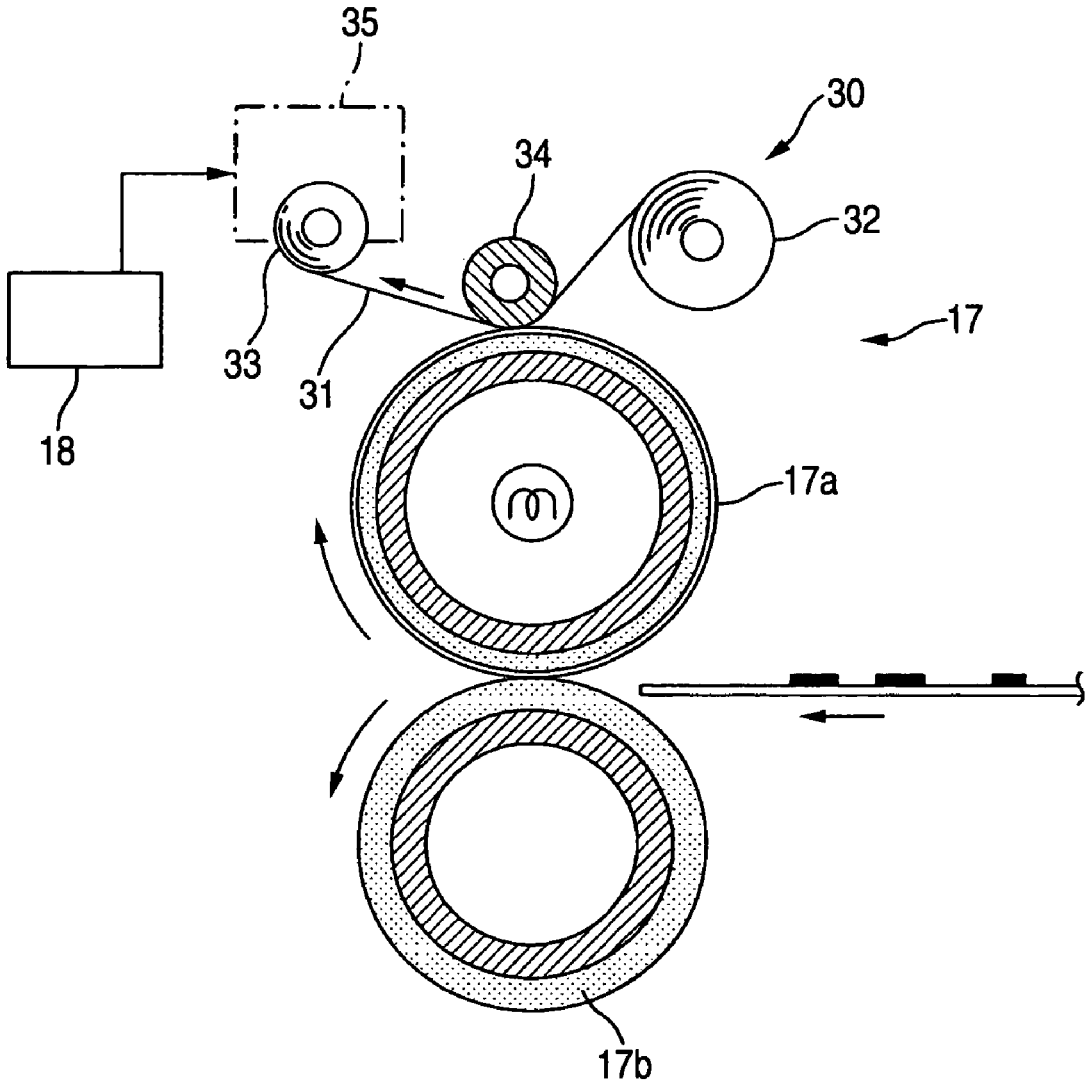
FIG. 5 is a schematic cross-sectional view showing a fixing unit for use in the image forming apparatus according to the invention.

The fixing unit 17 includes a heating roll 17*a* incorporating a halogen heater and a pressing roll 17*b* pressed and contacted with the heating roll, these rolls being arranged in parallel and pressed against each other to form a nip part, as shown in FIG. 5. The recording sheet onto which the toner image is transferred is forwarded into the nip part, and heated and pressed between the heating roll 17*a* and the pressing roll 17*b* which are being rotated, so that the molten toner is transferred on the recording sheet. Also, a cleaning unit 30 is disposed to make contact with a peripheral surface of the heating roll 17*a*.

In this embodiment, the heating roll 17*a* has an outer diameter of 65 mm. Also, the pressing roll 17*b* has a surface layer formed of rubber, and has an outer diameter of 65 mm.

The cleaning unit 30 includes a cleaning web 31, a delivery roll 32, a winding roll 33, and a contact roll 34. The cleaning web 31 is a continuous strip impregnated with silicon oil in the non-woven fabric, in which the unused portion of the strip is wound around the delivery roll 32. An end part drawn out of this delivery roll 32 is wound around the winding roll. And between the delivery roll 32 and the winding roll 33, the contact roll 34 presses a part of the cleaning web 31 from behind to make contact with the peripheral surface of the heating roll 17*a*.

The winding roll 33 is driven by a web driving device 35, rotating the delivery roll 32 under a tensile force transmitted via the cleaning web, so that the cleaning web is gradually advanced in a direction as indicated by the arrow in FIG. 5. That is, the cleaning web 31 is contacted with the heating roll, wiping with the peripheral surface of the heating roll along with the peripheral movement of the heating roll to clean it, whereby a new portion of the cleaning web is pressed onto the peripheral surface of the heating roll 17*a* at a slow speed at which the web is wound around the winding roll. And the web driving device 35 for driving the winding roll controls the proceeding speed of the cleaning web 31, based on a signal from the fixing control part 18.

The operation of the image forming apparatus is as follows.

The size of recording sheet and the number of sheets to form the image consecutively is selected, based on a signal inputted by the operator, or the image information and print volume from another apparatus. If the recording sheet accommodated in the sheet supply portion 6*a*, 6*b* is selected as the recording material, the set number of recording sheets are sequentially delivered from the sheet tray, and conveyed on the first sheet conveying path 7 toward the image forming part 3 by the conveying roller. On the other hand, if the paper feed from the manual sheet supply portion 6*b* is selected, the set number of recording sheets are sequentially drawn from the manual insertion tray, and conveyed on the second sheet conveying path 8 toward the image forming part 3. And two sheet conveying paths 7 and 8 are joined upstream of the position facing the transferring unit.

The image information is converted into a digital image signal. And the image forming part 3 forms an image, based on this digital image signal, and the signal processing device 21 counts the image density or area coverage to send the information to the fixing control part 18 for controlling the fixing unit 17. Also, the continuous print volume is also sent to the fixing control part 18.

The paper dust amount measuring device 9, facing conveying paths downstream of the position where the conveying paths 7 and 8 are joined, measures the amount of paper dust existing on the recording sheet to be conveyed as the paper dust density within the measurement space 10. And the measured paper dust density is sent as a voltage signal to the fixing control part 18 for controlling the fixing unit 17.

The image forming part 3 forms a toner image on the photosensitive drum 11, and the toner image is transferred onto the recording sheet delivered timingly to a portion facing the transferring unit 15. And the recording sheet is forwarded into a nip part between the heating roll 17*a* and the pressing roll 17*b* in the fixing unit 17. In the fixing unit, the heating roll 17*a* is driven and rotated, causing the pressing roll 17*b* to be rotated, whereby the toner image is heated and pressed, when passed between them, and transferred on the recording sheet to produce a fixed image.

The cleaning web wipes with the peripheral surface of the heating roll 17*a*, which is driven, so that the toner and paper dust adhering to the peripheral surface of the heating roll is wiped by the cleaning web. Also, the cleaning web is driven much slower than the peripheral surface of the heating roll, whereby a portion with the adhering toner or paper dust is shifted to the winding roll, and a new portion is placed into contact with the peripheral surface of the heating roll.

A driving control for the winding roll in the cleaning unit 30 will be described below.

The following Tables 1-3 list the paper dust amount, namely, the paper dust density in the measurement space 10 for the paper dust amount measuring device, the density of image portion, namely, the area coverage that is the area ratio of an image area on the recording sheet to a toner transferred portion within the image area, and the control value of running speed of the cleaning web 31 corresponding to the area coverage.

TABLE 1

| Paper dust density | 7 mg/m$^3$ or more | | |
|---|---|---|---|
| Area coverage | 0 to 5% | 5 to 20% | 20 to 100% |
| Web feed rate | 0.1 mm/s | 0.075 mm/s | 0.035 mm/s |

TABLE 2

| Paper dust density | 3 to 7 mg/m$^3$ | | |
|---|---|---|---|
| Area coverage | 0 to 5% | 5 to 20% | 20 to 100% |
| Web feed rate | 0.075 mm/s | 0.035 mm/s | 0.018 mm/s |

TABLE 3

| Paper dust density | 0 to 3 mg/m$^3$ | | |
|---|---|---|---|
| Area coverage | 0 to 5% | 5 to 20% | 20 to 100% |
| Web feed rate | 0.035 mm/s | 0.018 mm/s | 0.01 mm/s |

As indicated in the table 1, when the paper dust density is 7 mg/m$^3$ or more, the feed rate of the cleaning web is 0.1 mm/s if the area coverage detected from the image signal is from 0 to 5%, the feed rate is 0.075 mm/s if the area coverage is from 5 to 20%, and the feed rate is 0.035 mm/s if the area coverage is from 20 to 100%.

As indicated in the table 2, when the paper dust density is from 3 to 7 mg/m$^3$, the feed rate of the cleaning web is 0.075 mm/s if the area coverage detected is from 0 to 5%, the feed rate is 0.035 mm/s if the area coverage is from 5 to 20%, and the feed rate is 0.018 mm/s if the area coverage is from 20 to 100%.

As indicated in the table 3, when the paper dust density is from 0 to 3 mg/m$^3$, the feed rate of the cleaning web 31 is 0.035 mm/s if the area coverage detected is from 0 to 5%, the feed rate is 0.018 mm/s if the area coverage is from 5 to 20%, and the feed rate is 0.01 mm/s if the area coverage is from 20 to 100%.

As indicated in the tables 1-3, when the paper dust density is low and the area coverage is high, the amount of paper dust adhering to the heating roll 17*a* is small, whereby the feed rate of the cleaning web 31 can be reduced because the offset of the toner is less likely to be induced. If a large amount of paper dust is detected but the output image density is high, when the toner is also fixed on the recording sheet, the paper dust is pressed onto the recording sheet, suppressing the offset of the toner, whereby the toner transferred to the heating roll 17*a* can be removed even by reducing the feed rate of the cleaning web 31. However, if the paper dust density is high and the area coverage is low, a large amount of paper dust adheres to the heating roll 17*a*, and the toner is attracted to this adhering paper dust, often causing an offset phenomenon, whereby it is required to increase the feed rate of the cleaning web 31 to remove the paper dust securely.

In this way, since the feed rate of the cleaning web 31 is controlled according to the paper dust density and the area coverage, the offset of the toner is efficiently prevented, and the cleaning web 31 can be used for the long time, reducing the running cost.

Further, if the continuous print volume is large based on the data of the number of sheets to form the image, which is sent to the fixing control part 18, the proceeding speed of the cleaning web 31 may be controlled faster. If a number of images are fixed continuously, the paper dust is likely to remain in a pressed contact part of the fixing unit 17, tending to induce the offset of the toner, whereby the feed rate of the cleaning web 31 may be increased to appropriately prevent the offset of the toner.

Though in this embodiment, the feed rate of the cleaning web 31 is controlled based on the data of both the paper dust density and the area coverage, the feed rate of the cleaning web 31 may be controlled based on the control value of at least one of the paper dust density and the area coverage, in accordance with the following Table 4 or Table 5.

TABLE 4

| Paper dust density | 7 mg/m$^3$ or more | 3 to 7 mg/m$^3$ | 0 to 3 mg/m$^3$ |
|---|---|---|---|
| Web feed rate | 0.1 mm/s | 0.075 mm/s | 0.035 mm/s |

TABLE 5

| Area coverage | 0 to 5% | 5 to 20% | 20 to 100% |
|---|---|---|---|
| Web feed rate | 0.1 mm/s | 0.075 mm/s | 0.035 mm/s |

As described so far, according to an aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which has a pair of rotatable members contacted and pressed each other, in which the recording material on which the toner image is transferred is passed through the pair of rotatable members, and heats and presses the toner image to fix the toner image on the recording material, a cleaning section which cleans a peripheral surface of one of the pair of rotatable members of the fixing section, a paper dust amount measuring section which measures an amount of paper dust separably adhering to the recording material, before the toner image is transferred, and a control section which controls a cleaning operation rate of the cleaning section based on the amount of paper dust measured by the paper dust amount measuring section.

In the image forming apparatus, the cleaning section presses a part of a long cloth wound like a roll against the rotatable member and removes the paper dust adhering to the surface as the rotatable member is driven. And the quantity of driving the cloth is controlled based on the amount of paper dust measured by the paper dust amount measuring section. Accordingly, it is possible to prevent a lower cleaning efficiency from occurring due to adhering paper dust or toner by providing a suitable amount of driving the cloth, and effectively remove the paper dust and the toner from the surface of the toner.

In the image forming apparatus, the cleaning section is controlled to increase the quantity of driving the cloth, when the amount of paper dust measured by the paper dust amount measuring section is large, or decrease the quantity of driving the cloth, when the amount of paper dust measured is small. Therefore, when there is a small amount of paper dust or toner adhering to the peripheral surface of the rotatable member, the amount of driving the cloth can be reduced. Accordingly, it is possible to eliminate the waste in winding the cloth more than required, and achieve a longer life of the cleaning unit. That is, since the cloth is appropriately driven and adjusted according to the measured amount of paper dust, it is possible to fully exert the cleaning function, and make the effective use of the cloth.

In the image forming apparatus, this cloth is controlled, based on the density of image formed by the image forming section, to increase the driving amount when the density of image portion is low, or decrease the driving amount when the density of image portion is high. Thereby, it is possible to assure a longer life of the cloth that is the cleaning member and remove the toner from the surface of the rotatable member efficiently. That is, the paper dust on the recording material in a portion where the toner image is formed is pressed against the recording material, together with the toner, and does not adhere to the rotatable member. However, in the recording material in which the density of image portion is low, there is more white portion without the toner transferred. Since this white portion makes direct contact with the rotatable member, the paper dust existing on the recording sheet adheres to the rotatable member. Therefore, the offset is more likely to occur when the image with low image density is fixed than the image with high density of image portion is fixed on the recording material. Accordingly, if the amount of driving the cloth is changed depending on the density of image portion, it is possible to remove the toner and the paper dust securely, use the cloth for the long time, and reduce the running cost.

In the image forming apparatus, when a large number of sheets of recording material are consecutively passed, it is preferable to increase the amount of driving the cloth. When the number of consecutive copies is large, the paper dust is likely to remain in a contact part with the rotatable member, because the recording material is carried consecutively by this contact part, so that the paper dust adheres to the rotatable member to induce the offset of the toner. On the contrary, if the amount of driving the cloth is increased to maintain the cleaning function, the offset of the toner is prevented to suppress image contamination or image defect, even when a large number of sheets of recording material are consecutively passed.

According to the image forming apparatus, the amount of driving the cloth to clean the rotatable member as the fixing section is changed depending on the amount of paper dust adhering to the recording material or the density of image portion in the toner image transferred onto the recording material, it is possible to prevent the offset of the toner from being induced by the paper dust efficiently, suppress image contamination, and extend the use period of the cleaning unit by reducing the amount of driving the cloth.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming section which transfers toner onto a latent image due to a difference of electrostatic potential to form a toner image;

a transfer section which transfers the toner image onto a recording material directly or via an intermediate transfer body;

a fixing section which has a pair of rotatable members contacted and pressed each other, in which the recording material on which the toner image is transferred is passed through the pair of rotatable members, and heats and presses the toner image to fix the toner image on the recording material;

a cleaning section which cleans a peripheral surface of one of the pair of rotatable members of the fixing section;

a paper dust amount measuring section which measures an amount of paper dust separably adhering to the recording material, before the toner image is transferred; and a control section which controls a cleaning operation rate of the cleaning section based on the amount of paper dust measured by the paper dust amount measuring section.

2. The image forming apparatus according to claim 1, wherein the cleaning section comprises:

a long cloth;

a delivery roll which delivers the cloth wound around the delivery roll;

a contact roll which places a part of the delivered cloth into contact with any one of the pair of rotatable members; and a winding roll which winds the cloth apart from the any one rotatable member, wherein a part of the cloth contact with the any one rotatable member is gradually moved by winding.

3. The image forming apparatus according to claim 1, wherein the control section controls the cleaning section so that the cleaning operation rate is increased when a large amount of paper dust is measured by the paper dust amount measuring section, while the cleaning operation rate is decreased when a small amount of paper dust is measured by the paper dust amount measuring section.

4. The image forming apparatus according to claim 1, wherein the control section controls the cleaning section so that the cleaning operation rate is increased when a set value of continuous print volume is large.

5. An image forming apparatus, comprising:

an image forming section which transfers toner onto a latent image due to a difference of electrostatic potential to form an image including a toner image;

a transfer section which transfers the toner image onto a recording material directly or via an intermediate transfer body;

a fixing section which has a pair of rotatable members contacted and pressed each other, in which the recording material on which the toner image is transferred is passed through the pair of rotatable members, and heats and presses the toner image to fix the toner image on the recording material;

a cleaning section which cleans a peripheral surface of one of the pair of rotatable members of the fixing section; and a control section which controls a cleaning operation rate of the cleaning section based on an area ratio of an image area on the recording material to a toner transferred portion within the image area.

6. The image forming apparatus according to claim 5, wherein the cleaning section comprises:

a long cloth;

a delivery roll which delivers the cloth wound around the delivery roll;

a contact roll which places a part of the delivered cloth into contact with any one of the pair of rotatable members; and a winding roll which winds the cloth apart from the any one rotatable member, wherein a part of the cloth contact with the any one rotatable member is gradually moved by winding.

7. The image forming apparatus according to claim 5, wherein the control section controls the cleaning section so that the cleaning operation rate is increased when an area ratio of an image area on the recording material to a toner transferred portion within the image area is low, while the cleaning operation rate is decreased when the density of the portion where the toner is transferred is high.

8. The image forming apparatus according to claim 5, wherein the control section controls the cleaning section so that the cleaning operation rate is increased when a set value of continuous print volume is large.

9. An image forming apparatus, comprising:

an image forming section which transfers toner onto a latent image due to a difference of electrostatic potential to form an image including a toner imaged;

a transfer section which transfers the toner image onto a recording material directly or via an intermediate transfer body;

a fixing section which has a pair of rotatable members contacted and pressed each other, in which the recording material on which the toner image is transferred is passed through the pair of rotatable members, and heats and presses the toner image to fix the toner image on the recording material;

a cleaning section which cleans a peripheral surface of one of the pair of rotatable members of the fixing section;

a paper dust amount measuring section which measures an amount of paper dust separably adhering to the recording material, before the toner image is transferred; and a control section which controls a cleaning operation rate of the cleaning section based on at least one of the amount of paper dust measured by the paper dust amount measuring section and a density of portion where the toner is transferred in the image formed by the image forming section.

* * * * *